US005387392A

United States Patent [19]

Bramfitt et al.

[11] Patent Number: 5,387,392

[45] Date of Patent: Feb. 7, 1995

[54] HIGH STRENGTH, HIGH TOUGHNESS STEEL GRADE AND GAS CYLINDER THEREOF

[75] Inventors: Bruce L. Bramfitt, Bethlehem, Pa.; Leonard C. Luscomb, Longview, Tex.

[73] Assignee: Bethlehem Steel Corporation, Bethlehem, Pa.

[21] Appl. No.: 111,546

[22] Filed: Aug. 25, 1993

[51] Int. Cl.[6] ..... C22C 38/12; C22C 38/04

[52] U.S. Cl. ..... 420/105; 148/334

[58] Field of Search ..... 148/334; 420/105

[56] References Cited

U.S. PATENT DOCUMENTS 4,461,657 7/1984 Rana et al. ..... 148/334
5,030,297 7/1991 Vespermann et al. ..... 148/334
5,133,928 7/1992 Oldfield ..... 420/105

FOREIGN PATENT DOCUMENTS 426367 of 1991 European Pat. Off. .
59-96217 6/1984 Japan ..... 148/334

OTHER PUBLICATIONS

Naylor, Development of Application of High Strength Steals G. Costed Weight Reduction.

*Primary Examiner*—Deborah Yee
*Attorney, Agent, or Firm*—Joseph W. Berenato, III

[57] ABSTRACT

A high strength, high toughness steel comprising from about 0.32 to about 0.36 percent by weight carbon, from about 0.40 to about 0.60 percent by weight manganese, from about 0.15 to about 0.35 percent by weight silicon, from about 0.80 to about 1.10 percent by weight chromium, from about 0.55 to about 0.70 percent by weight molybdenum, from about 0.01 to about 0.05 percent by weight aluminum, from about 0.002 to about 0.004 calcium, no more than about 0.015 percent by weight phosphorus, no more than about 0.008 percent by weight sulfur, with the balance being iron.

20 Claims, 2 Drawing Sheets

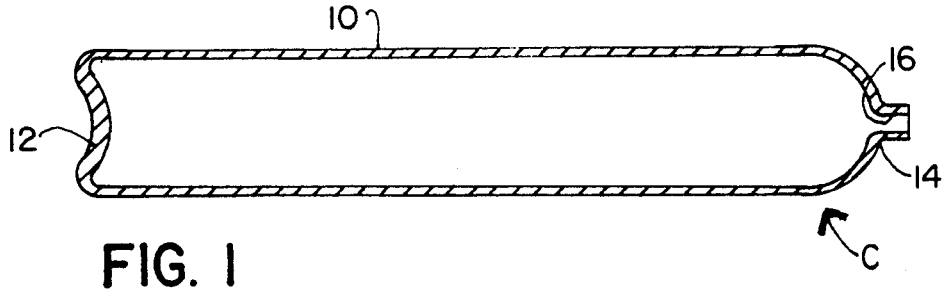
FIG. 1
FIG. 2
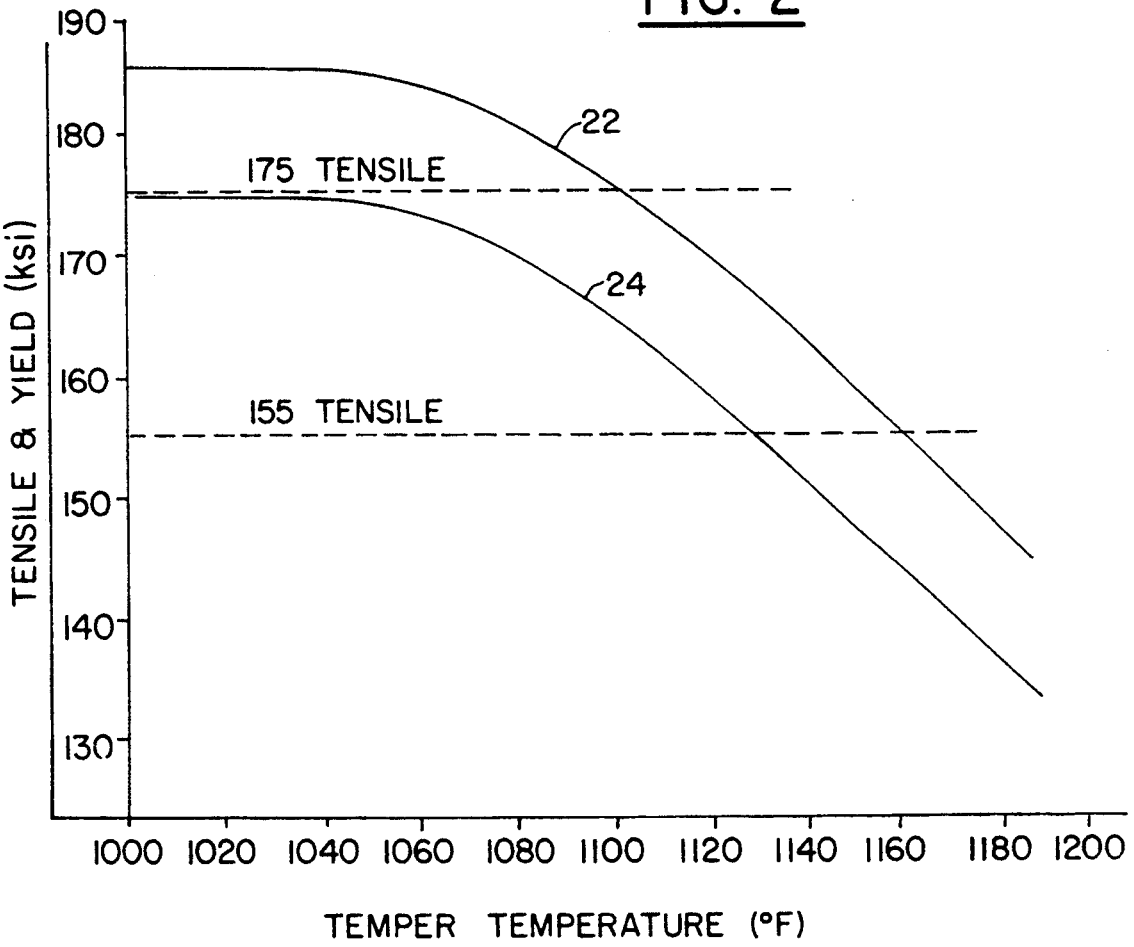

HIGH STRENGTH, HIGH TOUGHNESS STEEL GRADE AND GAS CYLINDER THEREOF

FIELD OF THE INVENTION

This invention relates to a steel grade having high strength and high toughness for use in the manufacture of cylinders for pressurized gas. More specifically, the steel grade is a modified AISI 4130 alloy steel having a relatively high molybdenum content, a relatively low sulfur content, and a calcium addition for inclusion shape control.

BACKGROUND OF THE INVENTION

Cylinders manufactured from steel have been used for quite a number of years for holding pressurized gases in order to permit storage, shipment, and selective use thereof. The steel cylinder must be able to not only contain the gas, but must also to withstand the impacts, stresses, and environmental conditions to which the cylinder is subject over its sometimes rather substantial life.

Because pressurized gas steel cylinders are frequently shipped from one point to another, then the Department of Transportation has issued certain rules and regulations concerning their manufacture and specifications thereabout. These regulations, among other issues, address the stress which the cylinder must withstand at its service pressure, and certain requirements intended to insure that the cylinder will not suddenly rupture other than in the event of certain unusual and extraordinary situations.

Although standard pressurized gas steel cylinders in compliance with the regulations of the Department of Transportation are known, such as in compliance with Specification 3AA, there is a need for a cylinder able to withstand an even higher stress at its service pressure and which will resist rupturing even when a fracture of the cylinder wall has occurred. The disclosed invention meets these needs, and others, by providing a steel having a high molybdenum content, a low sulfur content, and a calcium addition for inclusion shape control.

OBJECTS AND SUMMARY OF THE INVENTION

The primary object of the disclosed invention is to provide a steel grade having high strength and high toughness for use in the manufacture of cylinders for pressurized gases.

Yet a further object of the disclosed invention is to provide a pressurized gas cylinder having a body comprised of a steel having high strength and high toughness.

A high strength, high toughness steel comprises from about 0.32 to about 0.36 percent by weight carbon, from about 0.40 to about 0.60 percent by weight manganese, from about 0.15 to about 0.35 percent by weight silicon, from about 0.80 to about 1.10 percent by weight chromium, from about 0.55 to about 0.70 percent by weight molybdenum, from about 0.01 to about 0.05 percent by weight aluminum, no more than about 0.008 percent by weight sulfur, with the balance being iron.

A gas cylinder according to the invention includes a body comprised of steel comprising from about 0.32 to about 0.36 percent by weight carbon, from about 0.40 to about 0.60 percent by weight manganese, from about 0.15 to about 0.35 percent by weight silicon, from about 0.80 to about 1.10 percent by weight chromium, from about 0.55 to about 0.70 percent by weight molybdenum, from about 0.01 to about 0.05 percent by weight aluminum, no more than about 0.008 percent by weight sulfur, with the balance being iron.

These and other objects and advantages of the invention will be readily apparent in view of the following description and drawings of the above described invention.

DESCRIPTION OF THE DRAWINGS

The above and other objects and advantages and novel features of the present invention will become apparent from the following detailed description of the preferred embodiment of the invention illustrated in the accompanying drawings, wherein:

FIG. 1 is a cross-sectional view of a steel cylinder for pressurized gases pursuant to the invention;

FIG. 2 is a graph illustrating the tensile strength and of steel grades as a function of the temper temperature;

DESCRIPTION OF THE INVENTION

Figure 3:
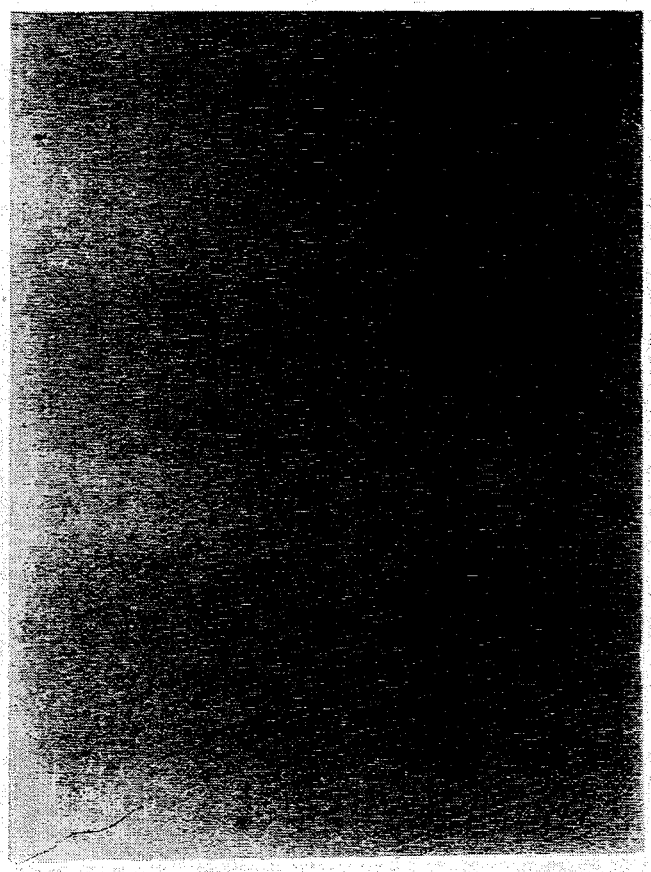
FIG. 3 is a photomicrograph of a portion of a specimen of the steel grade pursuant to the invention.

Cylinder C, as best shown in FIG. 1, is an integral steel body manufactured by the billet piercing backward extrusion process. The sidewall 10 is formed by hot drawing, with the bumped bottom 12 being formed in conventional manner. The valve end 14 of the cylinder C is closed by the hot spinning process. Valve end 14 has an aperture 16 therethrough communicating with the interior of cylinder C, and to which a valve (not shown) customarily would be operably secured for controlling the flow of pressurized gas to and from the cylinder C.

Cylinder C is manufactured from a modified AISI 4130 alloy steel, with the major alloying elements being carbon, manganese, silicon, and chromium. The steel has a relatively high molybdenum content, relatively low sulfur content, and a calcium addition for inclusion shape control. In addition a low phosphorus content results in a cleaner steel having overall improvement in mechanical properties, with the low sulfur content reducing the quantity of unwanted nonmetallic inclusions. A calcium addition converts whatever inclusions still remain from the common elongated configuration, which has a tendency to increase crack propagation, to an essentially spherical shape which minimizes crack propagation.

The high strength of the steel is achieved through alloying additions of carbon, chromium, molybdenum and manganese. The alloying additions provide a fine-grained, tempered, martensite structure after heat treatment by quenching and tempering. The relatively high molybdenum and the relatively low manganese contents provide improved resistance to temper embrittlement and greater temper resistance. The increased toughness is achieved by the fine tempered martensitic microstructure, combined with the low sulfur and sulfide shaped control achieved by the calcium addition.

The steel of the invention is preferably manufactured from an electric or basic oxygen furnace grade of steel of fine grain forging quality. The steel should have no more than trace levels of vanadium, because vanadium degrades toughness, and avoids high manganese levels which promote temper embrittlement. Preferably there is a manganese to sulfur ratio of at least 50:1. Because of the relatively high manganese to sulfur ratio, there is sufficient manganese to avoid the formation of iron sulfide inclusions which are detrimental to the properties and processing of the resulting steel. The manganese combines with the sulfur, thereby eliminating the combination of the sulfur with the iron. Iron sulfide is very brittle and thus degrades the properties of the steel. Iron sulfide also has a low melting point, and thus may create hot shortness at rolling and extrusion temperatures. Because of the low sulfur level of the invention, then relatively little manganese is required to maintain a 50:1 ratio of manganese to sulfur.

Table 1 sets forth an analysis range of the percentage by weight of the elements of the steel of the invention. In addition, chemical analysis in one sample indicated a vanadium content of 0.007 percent by weight, a nickel content of 0.09 percent by weight, a copper content of 0.17 percent by weight, and a calcium content of 0.0034 percent by weight. The vanadium, nickel, and copper contents are so insignificant as to be considered trace, thereby having little or no impact on the resulting steel produced.

TABLE I

| Element | Heat Analysis | Check Analysis Tolerances | |
|---|---|---|---|
| | | Under minimum | Over maximum |
| Carbon | 0.32/0.36 | 0.01 | 0.02 |
| Manganese | 0.40/0.60 | 0.03 | 0.03 |
| Phosphorus | 0.015 max. | — | 0.01 |
| Sulfur | 0.008 max. | — | 0.00 |
| Silicon | 0.15/0.35 | 0.02 | 0.02 |
| Chromium | 0.80/1.10 | 0.03 | 0.03 |
| Molybdenum | 0.55/0.70 | 0.03 | 0.03 |
| Aluminum | 0.01/0.05 | 0.00 | 0.00 |
| Calcium | 0.002/0.004 | | |

In one batch of the steel of the invention, the chemical analysis was 0.32 percent by weight carbon, 0.54 percent by weight manganese, 0.012 percent by weight phosphorus, 0.008 percent by weight sulfur, 0.28 percent by weight silicon, 0.97 percent by weight chromium, 0.65 percent by weight molybdenum, 0.007 percent by weight vanadium, 0.09 percent by weight nickel, 0.17 percent by weight copper, 0.03 percent by weight aluminum, with the balance being iron.

The various elements of the steel composition each play a different role. Carbon, for example, provides hardenability and strength. Manganese is also provided for hardenability and some solid solution strengthening, although the main role is to tie-up sulfur in order to minimize the formation of iron sulfides which lead to hot shortness and poor toughness. Phosphorus and sulfur are not desired, but current practices cannot totally eliminate them. Silicon and aluminum are deoxidants, with the silicon reducing the oxygen content and the aluminum tying-up the nitrogen while promoting a fine grain microstructure. Chromium and molybdenum improve hardenability, with calcium being added to improve inclusion shape control.

Figure 4:
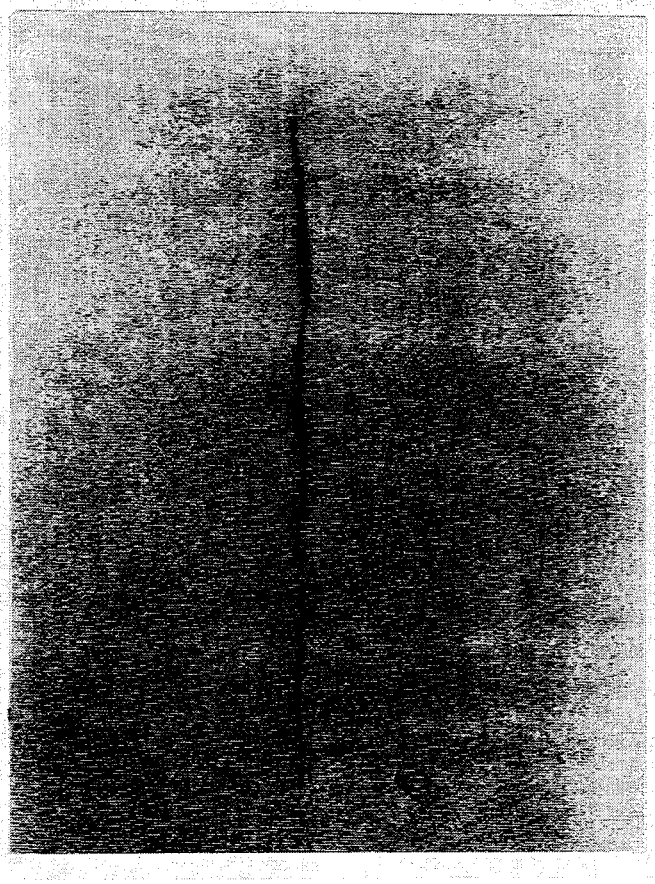
FIG. 4 is a photomicrograph of a steel specimen not having a calcium addition pursuant to the invention.

As noted earlier, sulfur and manganese combine to produce manganese sulfide and form elongated stringers which tend to weaken the steel over the length of the inclusion. FIG. 4 is a photomicrograph illustrating a steel having the low sulfur content of the steel of the invention, without that steel, however, having the calcium treatment which controls the configuration of inclusions. The longitudinally extending sulfide inclusions are clearly apparent in FIG. 4, and there is a commensurate weakening in the steel over the length of the inclusions. The weakening is generally in a direction transverse to the forming or circumferential direction, which is also the direction of greatest cylinder stress.

Table II contains the chemical analysis for five test grades of steel as compared with a standard steel grade complying with DOT specification 3AA.

TABLE II

| Steel Grade | C | Mn | P | S | Si | Cr | Mo | Al | V |
|---|---|---|---|---|---|---|---|---|---|
| Standard 3AA | 0.32 | 0.57 | 0.012 | 0.015 | 0.28 | 0.96 | 0.20 | — | — |
| High Strength 1 | 0.34 | 0.76 | 0.011 | 0.004 | 0.23 | 0.96 | 0.17 | 0.026 | 0.080 |
| High Strength 2 | 0.35 | 0.80 | 0.013 | 0.005 | 0.25 | 0.98 | 0.17 | 0.026 | 0.130 |
| High Strength 3 | 0.33 | 0.80 | 0.010 | 0.008 | 0.26 | 0.99 | 0.43 | 0.033 | NA |
| High Strength 4 | 0.32 | 0.54 | 0.012 | 0.008 | 0.28 | 0.97 | 0.65 | 0.030 | 0.007 |
| High Strength 5 | 0.33 | 0.70 | 0.010 | 0.006 | 0.24 | 0.94 | 0.47 | 0.024 | 0.006 |

NA = data not available

Table III compares various properties of the five grades of steel of Table II to a standard steel grade complying with DOT specification 3AA. It can be seen from Table III that high strength steel 4, which corresponds to the steel of the invention, has the highest tensile strength, good elongation, and excellent Charpy impact energy results.

TABLE III

| Steel Grade | Tensile Strength | Elongation in 2" | Charpy Impact Energy Room Temp. | | −50° C. | |
|---|---|---|---|---|---|---|
| | | | Long. | Trans. | Long. | Trans. |
| Standard 3AA | 120 ksi | 26% | 141 | 62 | 126 | 53 |
| High Strength 1 | 166 | 19 | 102 | 51 | 59 | 40 |
| High Strength 2 | 168 | 19 | 92 | 47 | 37 | 24 |
| High Strength 3 | 167 | 18 | 113 | 45 | 103 | 42 |
| High Strength 4 | 171 | 22 | 113 | 76 | 104 | 70 |
| High Strength 5 | 169 | 20 | NA | 69 | NA | 54 |

Table IV sets forth for each of the test grades of steel the principal characteristics which each contained. High strength steel 4 which, pursuant to Table III, had the best physical characteristics for use as a thin-wall, high strength pressurized cylinder, was principally distinguishable from the other steel grades by having been calcium treated, containing relatively low manganese, and having relatively high molybdenum.

TABLE IV

| | | | | |
|---|---|---|---|---|
| High Strength 1 | low-sulfur, not calcium-treated | high-Mn | low-Mo | contains V |
| High Strength 2 | low-sulfur, not calcium-treated | high-Mn | low-Mo | contains V |
| High Strength 3 | low-sulfur, not calcium- | high-Mn | medium-Mo | |

TABLE IV-continued

| | | | |
|---|---|---|---|
| | treated | | |
| High Strength 4 | low sulfur, calcium-treated | low-Mn | high-Mo |
| High Strength 5 | low sulfur, calcium-treated | high-Mn | medium-Mo |

A comparison of high strength steels 1 and 2 with high strength steels 3 and 4 establishes pursuant to Table II that high strength steels 1 and 2 have a vanadium addition. High strength steels 1 and 2 have relatively low longitudinal Charpy impact energies at −50° C. as compared with high strength steels 3 and 4. Tables II and III also indicate that as the vanadium content increases, 0.13 in high strength steel 2 and 0.08 in high strength steel 1, then the toughness of the steel degrades even more.

A comparison of high strength steel 3 with high strength steel 4 establishes the importance of the calcium addition for inclusion shape control. The sulfide inclusion of high strength steel 3 will be in the form of stringers, as best shown in FIG. 4, while the inclusion in high strength steel 4 will be of a spherical configuration, as best shown in FIG. 3. The stringers will tend to create anisotropic impact properties, whereas the spherical particles will tend to minimize anisotropy.

High strength steel 4 of the invention principally differs from high strength steel 5 by the relatively high molybdenum content and the relatively low manganese content. The high molybdenum content is believed responsible for the high transverse Charpy impact energies, and also contributes to a finer martensitic microstructure which leads to improved toughness. The major effect of molybdenum, however, is to enhance temper resistance.

FIG. 2 plots the tensile strength versus temper temperature for high strength steel 4 as curve 22 and high strength steel 5 as curve 24. It can be seen from the curves of FIG. 2 that the high molybdenum content of high strength steel 4 maintain a high level of tensile strength, while the steel of high strength 5 having the lower molybdenum, content decreases in tensile strength over the same tempering temperature range.

The minimum tempering temperature is specified as 1,100° F., with the minimum and maximum tensile strength levels being specified as 155 ksi and 175 ksi, respectively. Due to commercial production practices, high strength steel 5 is not feasible for these specifications due to fluctuations in temperature, while high strength steel 4 has a relatively wide temper temperature window sufficient to attain the specified tensile strength levels.

FIG. 3 is a photomicrograph of a steel specimen of the invention, in which it can be seen that the sulfide inclusions are essentially of a spherical shape. Because the inclusions have a spherical shape, then the transverse toughness and strength of the cylinder is greatly improved. Because of the spherical nature of the inclusions, an increase in resistance to crack propagation in the cylinder is provided in the event the steel should be penetrated. The increased resistance to crack propagation maximizes the likelihood of a safe leak without a catastrophic failure occurring.

The steel of the invention must be heat treated prior to being useable in pressurized gas cylinder form. The heat treatment consists of austenitizing the steel at a temperature not in excess of 1,700° F., with that temperature being maintained for at least 1 hour per inch of cylinder thickness. Upon exiting the furnace, the cylinder is quenched in a liquid medium having a cooling rate not in excess of 80% of the quenching rate of water. Following quenching, the cylinder is tempered at a temperature below the transformation range, but not less than a temperature of 1,100° F.

The cylinders may be hardness tested on the cylinder or body section after final heat treatment. The tensile strength equivalent of the hardness number must not be more than 182 ksi (RC 40 or BHN 371).

AISI 4130 steel can be heat treated to the 155 to 175 ksi tensile strength of the invention, but in so doing the steel loses much of its toughness and resistance to crack initiation and crack growth. AISI 4130 steel generally would not be suitable at these strength levels for the uses to which the present invention may be put, which may include use in articles other than gas cylinders.

FIG. 2 is a graph illustrating the tensile strength and the yield of the steel of the invention as a function of tempering temperature. Curves 22 and 24, respectively, are the tensile strength of the steels of high strength 4 and 5, respectively with the tempering having been carried out at a temperature of from about 1,060° to 1,110° F.

The steel of the invention has excellent impact resistance and Charpy V-notch impact tests. At room temperature, the transverse toughness was 63 J/cm$^2$ for test coupons, with a longitudinal toughness of 113 J/cm$^2$ and 76 J/cm$^2$ for transverse toughness from test cylinders. The corresponding results at a temperature of 0° F. were 69 J/cm$^2$ from the coupons, with 109 and 113 J/cm$^2$ for the longitudinal and transverse toughness. At −50° C., the coupons demonstrated a transverse toughness of 60 J/cm$^2$, with the cylinders demonstrating toughness in the longitudinal direction of 104 J/cm$^2$ and in the transverse direction 70 J/cm$^2$. The enhanced metallurgical properties resulting from the shape control of the sulfide inclusions are readily demonstrated from the Charpy V-impact tests, wherein the transverse impact values are nearly 70% of the longitudinal values.

While this invention has been described as having a preferred design, it is understood that it is capable of further modifications, uses and/or adaptations of the invention, following the general principle of the invention and including such departures from the present disclosure as come within known or customary practice in the art to which the invention pertains, and as may be applied to the central features herein before set forth, and falls within the scope of the invention of the limitations of the appended claims.

What we claim is:

1. High strength, high toughness steel comprising:

a) from about 0.32 to about 0.36 percent by weight carbon;

b) from about 0.40 to about 0.60 percent by weight manganese;

c) from about 0.15 to about 0.35 percent by weight silicon;

d) from about 0.80 to about 1.10 percent by weight chromium;

e) from about 0.55 to about 0.70 percent by weight molybdenum;

f) from about 0.01 to about 0.05 percent by weight aluminum;

g) no more than about 0.008 percent by weight sulfur; and h) the balance being iron.

2. The steel of claim 1, wherein:

a) said steel having been calcium treated for inclusion shape control so that the calcium content is at least about 0.002 percent by weight.

3. The steel of claim 2, wherein:

a) said carbon content is 0.32 percent by weight;

b) said manganese content is 0.54 percent by weight;

c) said silicon content is 0.28 percent by weight;

d) said chromium content is 0.97 percent by weight;

e) said molybdenum content is 0.65 percent by weight; and f) said aluminum content is 0.03 percent by weight.

4. The steel of claim 3, further comprising:

a) no more than 0.007 percent by weight vanadium;

b) no more than 0.09 percent by weight nickel; and c) no more than 0.17 percent by weight copper.

5. The steel of claim 2, wherein:

a) the ratio of manganese to sulfur is at least 40:1.

6. The steel of claim 5, wherein:

a) the ratio of manganese to sulfur is 50:1.

7. The steel of claim 2, wherein:

a) the calcium content is from about 0.002 percent by weight to about 0.004 percent by weight.

8. The steel of claim 1, wherein:

a) said steel having been austenitized at a temperature not exceeding 1,700° F.

9. The steel of claim 8, wherein:

a) said having a tensile strength of about 155 to about 175 ksi.

10. The steel of claim 8, wherein:

a) said steel having a hardness of at least 40 RC.

11. The steel of claim 8, wherein:

a) said steel having been tempered at a temperature of not less than 1,100° F. after austenitizing and quenching.

12. In a gas cylinder, a steel cylinder body comprising:

a) from about 0.32 to about 0.36 percent by weight carbon;

b) from about 0.40 to about 0.60 percent by weight manganese;

c) from about 0.15 to about 0.35 percent by weight silicon;

d) from about 0.80 to about 1.10 percent by weight chromium;

e) from about 0.55 to about 0.70 percent by weight molybdenum;

f) from about 0.01 to about 0.05 percent by weight aluminum;

g) no more than about 0.008 percent by weight sulfur; and h) the balance being iron.

13. The body of claim 12, wherein:

a) the steel having been calcium treated for inclusion shape control so that the calcium content is from about 0.002 percent by weight to about 0.004 percent by weight.

14. The body of claim 13, wherein:

a) the steel having a tensile strength of from about 155 to 175 ksi.

15. The body of claim 13, wherein:

a) said body having been austenitized at a temperature not exceeding 1,700° F.; and b) said body having been tempered at a temperature of not less than 1,100° F.

16. The body of claim 12, wherein:

a) the ratio of the manganese content to the sulfur content in the steel is at least 40:1.

17. The body of claim 16, wherein:

a) the ratio of manganese to sulfur is at least 50:1.

18. The body of claim 13, further comprising:

a) a phosphorus content of no more than 0.015 percent by weight.

19. The body of claim 12, wherein:

a) the sulfide inclusions in the steel are spherical.

20. High strength, high toughness steel consisting essentially of:

a) from about 0.32 to about 0.36 percent by weight carbon;

b) from about 0.40 to about 0.60 percent by weight manganese;

c) from about 0.15 to about 0.35 percent by weight silicon;

d) from about 0.80 to about 1.10 percent by weight chromium;

e) from about 0.55 to about 0.70 percent by weight molybdenum;

f) from about 0.01 to about 0.05 percent by weight aluminum;

g) no more than about 0.008 percent by weight sulfur; and h) the balance being iron.

* * * * *